US010232426B2

(12) United States Patent
Maki et al.

(10) Patent No.: US 10,232,426 B2
(45) Date of Patent: Mar. 19, 2019

(54) AUTOMOBILE PART AND METHOD FOR MANUFACTURING AUTOMOBILE PART

(71) Applicant: NIPPON STEEL & SUMITOMO METAL CORPORATION, Tokyo (JP)

(72) Inventors: Jun Maki, Tokyo (JP); Shintaro Yamanaka, Tokyo (JP); Hideaki Irikawa, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 38 days.

(21) Appl. No.: 15/106,136

(22) PCT Filed: Dec. 17, 2014

(86) PCT No.: PCT/JP2014/083420

§ 371 (c)(1),
(2) Date: Jun. 17, 2016

(87) PCT Pub. No.: WO2015/098653

PCT Pub. Date: Jul. 2, 2015

(65) Prior Publication Data

US 2016/0318093 A1 Nov. 3, 2016

(30) Foreign Application Priority Data

Dec. 25, 2013 (JP) ..... 2013-267794

(51) Int. Cl.
*B21D 53/88* (2006.01)
*B21D 22/20* (2006.01)
(Continued)

(52) U.S. Cl.
CPC ..... *B21D 53/88* (2013.01); *B21D 22/208* (2013.01); *C21D 8/0278* (2013.01);
(Continued)

(58) Field of Classification Search
CPC ..... B21D 53/88
(Continued)

(56) References Cited

U.S. PATENT DOCUMENTS 6,296,805 B1 10/2001 Laurent et al.
2001/0016268 A1 8/2001 Maki et al.
(Continued)

FOREIGN PATENT DOCUMENTS

CA 2831305 A1 * 10/2012
CN 1288073 A 3/2001
(Continued)

OTHER PUBLICATIONS

International Search Report for PCT/JP2014/083420 dated Mar. 17, 2015.
(Continued)

*Primary Examiner* — Tahseen Khan
(74) *Attorney, Agent, or Firm* — Birch, Stewart, Kolasch & Birch, LLP

(57) ABSTRACT

[Object] There are provided automobile parts and a method for manufacturing the automobile parts. The automobile parts have an excellent corrosion resistance after coated with a electrodeposition paint with smaller thickness, improve formability and productivity in hot pressing, and also improve chemical conversion treatability after hot press-forming.

[Solution] An automobile part according to the present invention includes: a formed steel sheet having an intermetallic compound layer formed on a surface of the steel sheet, the intermetallic compound layer being formed of Al—Fe intermetallic compound having a thickness of 10 μm or more and 50 μm or less, the intermetallic compound layer including a diffusion layer positioned in closest proximity to the steel sheet, the diffusion layer having a thickness of 10 μm
(Continued)

or less; a surface coating layer provided on a surface of the intermetallic compound layer, the surface coating layer including a coating containing ZnO and a zinc phosphate coating and having a surface roughness of 3 μm or more and 20 μm or less as a maximum profile height Rt in accordance with JIS B0601 (2001); and an electrodeposition paint film provided on a surface of the surface coating layer and having a thickness of 6 μm or more and less than 15 μm.

7 Claims, 2 Drawing Sheets

(51) Int. Cl.

| | |
|---|---|
| ***C25D 13/00*** | (2006.01) |
| ***C25D 13/20*** | (2006.01) |
| ***C22C 21/02*** | (2006.01) |
| ***C22C 38/14*** | (2006.01) |
| ***C21D 8/02*** | (2006.01) |
| ***C21D 9/46*** | (2006.01) |
| ***C23C 2/06*** | (2006.01) |
| ***C23C 2/40*** | (2006.01) |
| ***C23C 28/00*** | (2006.01) |
| ***C21D 8/04*** | (2006.01) |
| ***C21D 9/48*** | (2006.01) |
| ***C22C 21/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C23C 2/04*** | (2006.01) |
| ***C23C 22/07*** | (2006.01) |

(52) U.S. Cl.
CPC ..... *C21D 8/0478* (2013.01); *C21D 9/46* (2013.01); *C21D 9/48* (2013.01); *C22C 21/00* (2013.01); *C22C 21/02* (2013.01); *C22C 38/002* (2013.01); *C22C 38/02* (2013.01); *C22C 38/04* (2013.01); *C22C 38/06* (2013.01); *C22C 38/14* (2013.01); *C23C 2/04* (2013.01); *C23C 2/06* (2013.01); *C23C 2/405* (2013.01); *C23C 22/07* (2013.01); *C23C 28/32* (2013.01); *C23C 28/345* (2013.01); *C25D 13/00* (2013.01); *C25D 13/20* (2013.01); *C22C 38/00* (2013.01)

(58) Field of Classification Search
USPC ..... 428/216
See application file for complete search history.

(56) References Cited

U.S. PATENT DOCUMENTS

| | | | | |
|---|---|---|---|---|
| 2003/0029524 | A1* | 2/2003 | Rivera | C23C 22/12 148/262 |
| 2011/0030441 | A1* | 2/2011 | Maki | C23C 2/12 72/342.8 |
| 2014/0030544 | A1 | 1/2014 | Maki et al. | |

FOREIGN PATENT DOCUMENTS

| | | | |
|---|---|---|---|
| CN | 102066615 | A | 5/2011 |
| EP | 2695963 | A1 | 2/2014 |
| JP | 10-72641 | A | 3/1998 |
| JP | 2000-38640 | A | 2/2000 |
| JP | 2000-328216 | A | 11/2000 |
| JP | 2004-339530 | A | 12/2004 |
| JP | 2011-149084 | A | 8/2011 |
| JP | 2013-221202 | A | 10/2013 |
| JP | 2013-227620 | A | 11/2013 |
| KR | 10-2013-0132623 | A | 12/2013 |
| RU | 2412278 | C2 | 2/2011 |
| RU | 2466210 | C2 | 11/2012 |
| WO | WO 2009/131233 | A1 | 10/2009 |
| WO | WO 2012/137687 | A1 | 10/2012 |

OTHER PUBLICATIONS

Kojima, "Innovative Technology to Achieve High Throwing Power in Cationic Electrodeposition Paint", TECHNO-COSMOS, Mar. 2003, vol. 16, pp. 26-31.
Office Action for corresponding TW 103144766 dated Apr. 19, 2016.
Written Opinion of the International Searching Authority for PCT/JP2014/083420 (PCT/ISA/237) dated Mar. 17, 2015.
Korean Office Action issued in corresponding Korean Application No. 10-2016-7017988 dated Mar. 31, 2017, together with partial English translation.
Chinese Office Action and Search Report, dated May 18, 2017, for corresponding Chinese Application No. 201480068599.0, with an English translation of the Chinese Office Action.
Japanese Office Action, dated May 30, 2017, for corresponding Japanese Application No. 2015-554782, with English translation.
Canadian Office Action and Search Report dated Aug. 22, 2017, for corresponding Canadian Application No. 2,933,039.
Extended European Search Report, dated Jun. 23, 2017, for corresponding European Application No. 14874377.6.
Suehiro et al., "Properties of Aluminum-coated Steels for Hot-forming," Nippon Steel Technical Report Overseas, Nippon Steel Co., Tokyo, JP, No. 88, Jul. 2003, pp. 16-21, XP002393305.
Korean Notification of Reasons for Refusal dated Oct. 31, 2017, for corresponding Korean Application No. 10-2016-7017988, with partial English translation.
Russian Office Action and Search Report dated Nov. 17, 2017, for corresponding Russian Application No. 2016128897, with an English translation.
Indian Office Action, dated Aug. 1, 2018, for corresponding Indian Application No. 201617021254, along with an English translation.

* cited by examiner

AUTOMOBILE PART AND METHOD FOR MANUFACTURING AUTOMOBILE PART

TECHNICAL FIELD

The present invention relates to an automobile part and a method for manufacturing the automobile parts.

BACKGROUND ART

Recently, it has been increasingly demanded to restrain the consumption of fossil fuels in order to control global warming and protect the environment, which has affected various manufacturing industries. For example, automobiles, which are an indispensable part of transportation means in daily life and activities, are not exception. There is a demand to improve fuel economy by, for example, reducing vehicle body weight. It is not allowed, however, to simply reduce the vehicle body weight by neglecting product qualities. It is necessary to secure appropriate safety.

Many of the structural parts of an automobile are made of ferrous material, in particular a steel sheet. For reducing the vehicle body weight, it is important to reduce the weight of the steel sheet. Instead of simply reducing the weight of the steel sheet, which is not allowed as mentioned above, the weight reduction must be accompanied with obtaining the mechanical strength of the steel sheet. Such demand becomes higher not only in the car manufacturing industry but also in various other manufacturing industries. Research and development efforts have been directed to a steel sheet that can have the same or a larger mechanical strength as compared to conventional one even when the sheet is made thinner.

In general, a material having a high mechanical strength tends to become lower in formability and shape fixability in shape formation work such as bending. It is difficult to carry out the process for forming such material into a complicated shape. One of the solutions to the formability problem is what is called "a hot pressing method (also referred to as hot stamping, hot pressing, die quenching, or press hardening)". In the hot pressing method, a material to be formed is heated temporarily to a high temperature (in an austenite region) and the steel sheet soften by the heating is formed by pressing. The steel sheet is then cooled. By using the hot pressing method, the material is once soften by heating to a high temperature so that the material is easy to be pressed. The mechanical strength of the material becomes larger due to a quenching effect during cooling after the shaping. Accordingly, the hot pressing can provide a product having both a good shape fixability and a high mechanical strength.

When the hot pressing method is applied to a steel sheet, however, iron and other substances on the surface are oxidized to generate scales (oxides) due to heating to a high temperature of, for example, 800° C. or more. Accordingly, a descaling process is necessary after hot pressing to remove the scales, which deteriorates productivity. For the members and the like that require corrosion resistance, it is necessary to carry out anti-corrosion treatment and metal cover installation on the surfaces of the members after the shaping process. A surface cleaning process and a surface treatment process are also necessary, which further deteriorates productivity.

As an example of restraining such deterioration in productivity, a covering layer can be installed on a steel sheet. In general, various materials including organic and inorganic materials are used for the covering layer on a steel sheet. Among them, galvanized steel sheets that have a sacrificial protection effect on steel sheets are widely used for steel sheets for automobiles and other products because the galvanized steel sheets provide a good anti-corrosion effect and suitability to steel sheet production technology. However, this may cause to considerable deterioration in the surface properties because heating temperatures used in the hot pressing (700 to 1000° C.) are higher than the temperatures at which the organic materials decompose or the zinc boils so that the plating layer evaporates at a time of heating by hot press.

For this reason, it is desirable to use, for example, what is called an Al-plated steel sheet for the hot pressing that heats the steel sheet to high temperatures. The Al-plated steel sheet is a steel sheet having an Al-based metal cover that has the boiling point higher than that of an organic material cover or Zn-based metal cover.

The Al-based metal cover can prevent scales from depositing on the surface of the steel sheet, which leads to omitting a process such as the descaling process and improving productivity. The Al-based metal cover also has an anti-corrosion effect so that the corrosion resistance of the steel sheet after coated with paint is improved. Patent Literature 1 listed below discloses a method for using an Al-plated steel sheet in hot pressing, the Al-plated steel sheet being obtained by covering a steel sheet having predetermined steel components with Al-based metal, as explained above.

However, in the case that the Al-based metal cover is applied like Patent Literature 1, the Al cover is melted and transformed into an Al—Fe compound due to the dispersion of Fe from the steel sheet, depending on preheating conditions before a pressing step in the hot pressing method. The Al—Fe compound grows until the Al—Fe compound reaches to the surface of the steel sheet. The compound layer is hereinafter referred to as the Al—Fe alloy layer. The Al—Fe alloy layer is so hard. That is because the Al—Fe alloy layer is intrinsically not smooth on the surface and is inferior in lubricity, comparatively. In addition, since the Al—Fe alloy layer tends to break, develop cracks in a plating layer, and come off in a powder form. Moreover, flaked materials from the Al—Fe alloy layer and coming-off materials by strong abrasion on the Al—Fe surface attach on the dies. The Al—Fe compound then adheres to and deposits on the dies, which leads to deterioration in the quality of pressed products. To prevent this, it is necessary to remove Al—Fe alloy powder adhered to the dies during maintenance, which is one of the causes for lowering productivity and increasing the cost.

Furthermore, the Al—Fe alloy layer is less reactive in phosphate treatment so that a chemical conversion coating (a phosphate coating), which is a treatment before electrodeposition painting, is difficult to generated. Although the chemical conversion coating is not formed, the Al—Fe alloy layer itself has a good coating adhesion ability with paint so that corrosion resistance after coated with paint becomes better if Al plating amount is large enough. An increase in the amount, however, tends to worsen the aforementioned adhesion to the dies.

On the other hand, Patent Literature 2 listed below discloses a technique in which a wurtzite-type compound is applied to the surface of an Al-plated steel sheet. According to the Patent Literature 2 listed below, such a process improves in lubricity in hot state and in chemical conversion treatability. This technique is effective for improving lubricity and also corrosion resistance after coated with paint.

In addition, Patent Literature 3 listed below discloses a technique for controlling the average section length of the crystal grains that are in an intermetallic compound phase and contain Al at an amount of 40% or more and 65% or less among the crystal grains of Al—Fe that is a main ingredient of the intermetallic compound phase formed on the surface of the steel sheet, and also for controlling the thickness of the intermetallic compound phase. The technique also includes forming of a lubricating coating containing ZnO on the surface of the Al plating layer. In Patent Literature 3 listed below, the corrosion resistance after coated with paint and the formability during hot stamping can be improved by using such techniques.

CITATION LIST

Patent Literature

Patent Literature 1 JP 2000-38640A
Patent Literature 2 WO 2009/131233A1
Patent Literature 3 WO 2012/137687A1

SUMMARY OF INVENTION

Technical Problem

As described in the foregoing, the Al-plated steel sheet plated with Al having the relatively high melting point is regarded as a promising member, for use as an automobile steel sheet, etc., that requires corrosion resistance. Modified techniques have been proposed in applying the Al-plated steel sheet to the process of hot pressing.

However, the above-described techniques known in the art have presupposed that the film thickness of the electrodeposition painting has been approximately 20 μm, which is relatively thick. However, in the electrodeposition painting that uses a method of immersing an automobile body, the film thickness affects cost largely. As a coated film of the electrodeposition painting has become thinner recently, it is necessary to maintain the properties in the thinner electrodeposition paint.

Patent Literature 1 listed above does not mention electrodeposition painting as is described above. Patent Literature 2 listed above indicates the thickness of the electrodeposition painting to be 20 μm. In addition, Patent Literature 3 listed above mentions a value of 1 to 30 μM as a thickness of the electrodeposition painting in general. These known techniques have been fine as far as relatively thick electrodeposition paints are presupposed, as described above. The situation changes drastically, however, when it comes to the thickness of an electrodeposition film being less than 15 μm.

More specifically, it is known that the surface roughness of a Al plated steel sheet is large after it is alloyed, which is substantially 2 μm as Ra in JIS B0601 (2001) (Ra is the arithmetic mean of roughness, which is the arithmetic mean of height Sa as specified in ISO 25178). When the surface having a large surface roughness is covered with a thin paint film, the actual paint film thickness on top of peaks of the alloy layer becomes small. As a result, corrosion under the paint film will start from the portions having a locally thin paint film. When a material has an average mean of roughness Ra of 2 μm, Rt (maximum profile height) according to JIS B0601 (2001) becomes about 20 μm for the material. The maximum profile height Rt of about 20 μm indicates that the peaks of about 10 μm may appear on the surface of the material. The Present Inventors found that, in such a case, when the film thickness of the electrodeposition painting is 14 μm, about 4 μm thick portions exist locally, and such portions may be corroded preferentially.

Note that Patent Literature 3 listed above only discloses an example of about 20 μm thick film alone of the electrodeposition painting in the embodiment, and it is not known whether to stably obtain the effect disclosed in Patent Literature 3 listed above also in a region where the thickness of the electrodeposition painting is less than 15 μm. In addition, Patent Literature 3 listed above does not disclose any knowledge about the relationship between corrosion and the maximum profile height Rt as described above.

The present invention is achieved in view of the above-described problems, and is directed to provide automobile parts that have an excellent corrosion resistance after coated with an electrodeposition paint film being less thick than ever before, that improve formability and productivity in hot pressing work, and that improve chemical conversion treatability after hot press-forming, and is also directed to provide a method for manufacturing the automobile parts.

Solution to Problem

As the results of studies to solve the above-described problems, the Present Inventors have found that a steel sheet comes to have a sufficient corrosion resistance after coated with paint, even if the thickness of the electrodeposition paint film is less than 15 μm, when the steel sheet is treated to have an intermetallic compound layer formed of an Al—Fe intermetallic compound on the surface of the steel sheet, and has a surface coating layer including a coating containing ZnO and a coating mainly containing zinc phosphate on the surface of the intermetallic compound layer, and when the surface roughness of the surface coating layer is controlled to have a predetermined threshold value or less. The Present Inventors have further found the conditions of Al plating and heating to achieve such surface roughness, and subsequently achieved the present invention. The gist of the present invention conceived on the basis of the above findings is as follows.

(1)

An automobile part, including:

a formed steel sheet having an intermetallic compound layer formed on a surface of the steel sheet, the intermetallic compound layer being formed of Al—Fe intermetallic compound having a thickness of 10 μm or more and 50 μm or less, the intermetallic compound layer including a diffusion layer positioned in closest proximity to the steel sheet, the diffusion layer having a thickness of 10 μm or less;

a surface coating layer provided on a surface of the intermetallic compound layer, the surface coating layer including a coating containing ZnO and a zinc phosphate coating and having a surface roughness of 3 μm or more and 20 μm or less as a maximum profile height Rt in accordance with JIS B0601 (2001); and an electrodeposition paint film provided on a surface of the surface coating layer and having a thickness of 6 μm or more and less than 15 μm.

(2)

The automobile part according to (1), wherein the maximum profile height Rt is 7 μm or more and 14 μm or less.

(3)

The automobile part according to (1) or (2), wherein the ZnO has an average grain size of 50 nm or more and 1000 nm or less in diameter.

(4)

The automobile part according to any one of (1) to (3), wherein a content of ZnO is 0.3 $g/m^2$ or more and 3 $g/m^2$ or less in metallic Zn equivalent for one surface.

(5)

The automobile part according to any one of (1) to (4), wherein the content of ZnO is 0.5 g/m$^2$ or more and 1.5 g/m$^2$ or less in metallic Zn equivalent for one surface.

(6)

The automobile part according to any one of (1) to (5), wherein the steel sheet is an Al plated steel sheet having an Al plating layer formed on a surface of the steel sheet serving as a base metal.

(7)

The automobile part according to (6), wherein the Al plating layer has an average primary crystal diameter of 4 μm or more and 40 μm or less.

(8)

The automobile part according to (6) or (7), wherein the Al plating layer has an average primary crystal diameter of 4 μm or more and 30 μm or less.

(9)

The automobile part according to any one of (6) to (8), wherein an amount of the Al plating layer is 30 g/m$^2$ or more and 110 g/m$^2$ or less for one surface.

(10)

The automobile part according to any one of (6) to (8), wherein an amount of the Al plating layer is 30 g/m$^2$ or more and less than 60 g/m$^2$ for one surface.

(11)

The automobile part according to any one of (6) to (8), wherein an amount of the Al plating layer is 60 g/m$^2$ or more and 110 g/m$^2$ or less for one surface.

(12)

A method for manufacturing an automobile part, the method including:

using an Al plated steel sheet including a coating containing ZnO on a surface of the Al plated steel sheet;

using a hot pressing method;

causing an Al plating layer having an average primary crystal diameter of 4 μm or more and 40 μm or less to have an amount of plating of 30 g/m$^2$ or more and 110 g/m$^2$ or less for one surface;

causing a ZnO amount of the Al plating layer to be 0.3 g/m$^2$ or more and 3 g/m$^2$ or less in metallic Zn equivalent for one surface;

causing a rate of temperature increase during a heating process in hot pressing to be 12° C./second or more;

causing a reaching steel sheet temperature to be 870° C. or more and 1100° C. or less; and causing a electrodeposition paint film to have thickness of 6 μm or more and less than 15 μm.

(13)

The method for manufacturing an automobile part according to (12), wherein an amount of the Al plating layer is 50 g/m$^2$ or more and 80 g/m$^2$ or less for one surface.

(14)

A method for manufacturing a high-strength automobile part, the method including:

using an Al plated steel sheet including a coating containing ZnO on a surface of the Al plated steel sheet;

using a hot pressing method;

causing an Al plating layer having an average primary crystal diameter of 4 μm or more and 40 μm or less to have an amount of plating of 30 g/m$^2$ or more and less than 60 g/m$^2$ for one surface;

causing a ZnO amount of the Al plating layer to be 0.3 g/m$^2$ or more and 3 g/m$^2$ or less as metallic Zn for one surface;

causing a rate of temperature increase during a heating process in hot pressing to be less than 12° C./second;

causing a reaching steel sheet temperature to be 850° C. or more and 950° C. or less; and causing a electrodeposition paint film to have thickness of 6 μm or more and less than 15 μm.

(15)

The method for manufacturing an automobile part according to (14), wherein an amount of the Al plating layer is 35 g/m$^2$ or more and 55 g/m$^2$ or less for one surface.

(16)

A method for manufacturing a high-strength automobile part, the method including:

using an Al plated steel sheet including a coating containing ZnO on a surface of the Al plated steel sheet;

using a hot pressing method;

causing an Al plating layer having an average primary crystal diameter of 4 μm or more and 40 μm or less to have an amount of plating of 60 g/m$^2$ or more and 110 g/m$^2$ or less for one surface;

causing a ZnO amount of the Al plating layer to be 0.3 g/m$^2$ or more and 3 g/m$^2$ or less as metallic Zn for one surface;

causing a rate of temperature increase during a heating process in hot pressing to be less than 12° C./second;

causing a reaching steel sheet temperature to be 920° C. or more and 970° C. or less; and causing a electrodeposition paint film to have thickness of 6 μm or more and less than 15 μm.

(17)

The method for manufacturing an automobile part according to (16), wherein an amount of the Al plating layer is 60 g/m$^2$ or more and 90 g/m$^2$ or less for one surface.

(18)

The method for manufacturing an automobile part according to any one of (12) to (17), wherein the content of ZnO is 0.5 g/m$^2$ or more and 1.5 g/m$^2$ or less in metallic Zn equivalent for one surface.

(19)

The method for manufacturing an automobile part according to any one of (12) to (18), wherein the Al plating layer has an average primary crystal diameter of 4 μm or more and 30 μm or less.

(20)

The method for manufacturing an automobile part according to any one of (12) to (19), further including:

treating the Al plated steel sheet with chemical conversion by using a chemical conversion liquid containing phosphates, before hot pressing.

Advantageous Effects of Invention

As described above, the present invention can provide the automobile parts that have an excellent corrosion resistance after coated with an electro-deposition paint film being less thick than ever before, that improve formability and productivity in hot pressing work, and that improve chemical conversion treatability after hot press-forming, and also can provide the method of manufacturing such automobile parts.

DESCRIPTION OF EMBODIMENTS

Figure 1:
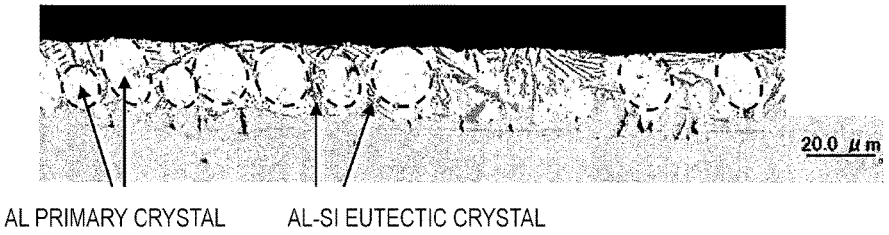
FIG. 1 is a cross-sectional photograph showing the cross-sectional structure of a typical Al plating layer.

Hereinafter, referring to the appended drawings, preferred embodiments of the present invention will be described in detail. It should be noted that, in this specification and the appended drawings, structural elements that have substantially the same function and structure are denoted with the same reference signs, and repeated explanation thereof is omitted.

(Plated Steel Sheet)

A plated steel sheet according to an embodiment of the present invention will be described.

A plated steel sheet according to the embodiment has a layered structure including at least two layers on one surface or each of both surfaces of the steel sheet. In other words, an Al plating layer containing at least Al is formed on one surface or each of both surfaces of the steel sheet, and a surface coating layer containing at least ZnO is further stacked on the Al plating layer.

<Steel Sheet>

For the steel sheet, it is desirable to use a steel sheet formed to have, for example, a high mechanical strength (which refers to properties related to mechanical deformation and failure, including, for example, tensile strength, yield point, elongation, contraction of area, hardness, impact value, fatigue strength, creep strength, etc.). A composition example of the steel sheet that achieves a high mechanical strength and can be employed in an embodiment of the present invention is described as follows.

For example, the steel sheet includes, in mass %, C: 0.1% or more and 0.4% or less, Si: 0.01% or more and 0.6% or less, Mn: 0.5% or more and 3% or less, Ti: 0.01% or more and 0.1% or less, B: 0.0001% or more and 0.1% or less, and the balance: Fe and impurities.

Each component added to steel will now be explained. Note that the term % represents "mass %" unless otherwise stated.

[C: 0.1% or More and 0.4% or Less]

C is added to secure a target mechanical strength. A content of C of less than 0.1% does not provide enough mechanical strength improvement, and makes C addition less effective. In contrast, the content of C exceeding 0.4% makes the steel sheet harden more, but is more likely to cause melting cracks. Accordingly, it is preferable to add C at a content of, in mass %, 0.1% or more and 0.4% or less. The content of C is more preferably 0.15% or more and 0.35% or less.

[Si: 0.01% or More and 0.6% or Less]

Si is one of the elements for improving mechanical strength and is added to secure a target mechanical strength in a way similar to C. If the content of Si is less than 0.01%, it is difficult to exhibit a strength-improving effect, and enough mechanical strength is not obtained. In contrast, Si is an element that is easily oxidized. Thus, the content of Si exceeding 0.6% lowers wettability during hot-dip Al plating, which is likely to cause the generation of non-plated portions. Accordingly, it is preferable to add Si at a content of, in mass %, 0.01% or more and 0.6% or less. The content of Si is more preferably 0.01% or more and 0.45% or less.

[Mn: 0.5% or More and 3% or Less]

Mn is one of the elements for strengthening steel and also one of the elements for increasing hardenability. Mn is also effective in preventing hot-brittleness caused by S that is one of the impurities. A content of Mn of less than 0.5% does not provide such an effect, which is exhibited when the content of Mn is 0.5% or more. In contrast, the content of Mn exceeding 3% may lower strength due to residual γ-phase becoming excessive. Accordingly, it is preferable to add Mn at a content of, in mass %, 0.5% or more and 3% or less. The content of Mn is more preferably 0.8% or more and 3% or less.

[Ti: 0.01% or More and 0.1% or Less]

Ti is one of the elements for improving strength and also an element for improving the heat resistance of the Al plating layer. A content of Ti of less than 0.01% cannot provide a strength-improving effect or an oxidation-resistance-improving effect, while these effects are achieved at a content of Ti of 0.01% or more. In contrast, Ti is also an element that may soften steel by forming, for example, carbides and nitrides if added excessively. In particular, if the content of Ti exceeds 0.1%, it is not likely to obtain a target mechanical strength. Accordingly, it is preferable to add Ti at a content of, in mass %, 0.01% or more and 0.1% or less. The content of Ti is more preferably 0.01% or more and 0.07% or less.

[B: 0.0001% or More and 0.1% or Less]

B is an element for improving strength by contributing to quenching. A content of B of less than 0.0001% does not provide such a strength-improving effect sufficiently. In contrast, the content of B exceeding 0.1% may lower fatigue strength by forming inclusions and making a brittle steel sheet. Accordingly, it is preferable to add B at a content of in mass %, 0.0001% or more and 0.1% or less. The content of B is more preferably 0.0001% or more and 0.01% or less.

[Optional Element]

As optional elements other than the above-described elements, the steel sheet contains, in many cases, Cr: 0.01% or more and 0.5% or less, Al: 0.01% or more and 0.1% or less, N: 0.001% or more and 0.02% or less, P: 0.001% or more and 0.05% or less, S: approximately, 0.001% or more and 0.05% or less. Cr exhibits a hardenability effect as is Mn, and Al is applied as a deoxidizer. It is needless to say that not all the optional elements must be added in the steel sheet.

[Impurity]

Incidentally, the steel sheet may have impurities that comes to be inevitably included in other manufacturing processes. Such impurities may include, for example, Ni, Cu, Mo, O and others.

A steel sheet formed of such components is quenched after heated by, for example, a hot pressing method so that the steel sheet may have a mechanical strength of about 1500 MPa or more. Although the steel sheet has such a high mechanical strength, it can be shaped easily when the hot pressing method is used because the steel sheet is soften by heating and is hot-pressed in a soft state. Moreover, a high mechanical strength can be achieved for the steel sheet, and the steel sheet can maintain or improve the mechanical strength even if the thickness of the steel sheet is reduced for the purpose of weight reduction.

<Al Plating Layer>

The Al plating layer is formed on one surface or both surfaces of the steel sheet as described above. The Al plating layer may be formed on the surface of the steel sheet by using, for example, a hot-dip plating method. The forming method of the Al plating layer according to the present invention, however, is not limited to such an example.

The Al plating layer contains Al as a plating component, and also contains Si in many cases. The content of Si in the plating composition can control an Al—Fe alloy layer that is generated when a metal cover is formed by hot-dip plating. If the content of Si is less than 3%, an Al—Fe alloy layer grows thick during Al plating, which may aggravate crack development during working, and may negatively impact on corrosion resistance. In contrast, the content of Si exceeding 15% may hamper the workability and corrosion resistance of the plating layer. Accordingly, it is preferable to add Si at a content of, in mass %, 3% or more and 15% or less.

Elements present in the Al plating bath, other than Si, include Fe at an amount of 2 to 4%, which is eluted from the equipment or steel strips in the plating bath. In addition to Si and Fe, elements such as Mg, Ca, Sr, Li, etc., may be included in the Al plating bath at an amount of approximately 0.01 to 1%.

The Al plating layer formed of such components can prevent the steel sheet from corroding. The Al plating layer can also prevent the steel sheet from generating the scales (iron oxides) that are generated by the oxidization of the steel sheet surfaces that are heated to a high temperature when shaping the steel sheet by the hot pressing method. Accordingly, forming of such Al plating layer can omit such processes as scale removing, surface cleaning, and surface treatment, and thus can improve productivity. The Al plating layer has the boiling point higher than that of a plating cover formed by organic-based materials or by metal-based materials (for example, Zn-based material). This allows the steel sheet to be shaped at high temperature in the shaping work using the hot pressing method, which leads to further improvement in formability during the hot pressing and also leading to easiness in shaping.

Note that an average primary crystal diameter in the Al plating layer is 4 μm or more and 40 μm or less. Incidentally, the average primary crystal diameter in the Al plating layer can be measured by observing a polished cross section using an optical microscope. In the Al plating, primary crystals are often Al, and eutectic crystals of Al—Si (Al—Si eutectic crystals) solidify at an end stage of solidification. Consequently, eutectic crystal portions made of Al—Si eutectic crystals are first identified, and then a structure present between adjacent eutectic crystal portions can be determined as the primary crystal portion made of the Al primary crystal. With the average primary crystal diameter in the Al plating layer being in such a range, a desired surface roughness is achieved in the surface coating layer, which will be described later.

FIG. 1 shows a cross-sectional structure of a typical Al plating layer. By observing the cross-sectional structure, the location of the primary crystal portions can be determined. In FIG. 1, regions surrounded by dotted lines are the primary crystal portions made of the Al primary crystal, and a region present between adjacent primary crystal portions is the eutectic crystal portion. Here, by converting an ellipse representing the primary crystal portion into a circle having the area equivalent to the ellipse, the diameter of the primary crystal portion (diameter of circle) is to be obtained. In calculating an average of the diameters of primary crystal portions obtained as described above, 10 diameters of the primary crystal portions in arbitral two field of views, in which 5 diameters are measured per one field of view, are to be averaged.

The average primary crystal diameter depends on the situation in which the alloy (in other words, eutectic crystal portion) is generated, and also depends on the cooling rate after plating. In reality, it is difficult to obtain a diameter of less than 4 μm. Consequently, the lower limit of the average primary crystal diameter is set at 4 μm or more. On the other hand, when the average primary crystal diameter is too large, which means the plating structure is partially not uniform, the partially nonuniform plating structure tends to cause the surface irregularities to be larger after heating. Consequently, the upper limit of the average primary crystal diameter is set at 40 μm. The average primary crystal diameter is more preferably 4 μm or more and 30 μm or less.

An amount of the Al plating may be (1) 30 g/m$^2$ or more and 110 g/m$^2$ or less per surface, (2) 30 g/m$^2$ or more and less than 60 g/m$^2$ per surface, or (3) 60 g/m$^2$ or more and 110 g/m$^2$ or less per surface. In the hot pressing method according to the embodiment of the present invention, a rate of temperature increase, a maximum steel sheet temperature to be reached, and the like, in the heating process of the hot pressing method are controlled according to the amount of the Al plating, which will be described later.

Here, the amount indicated in (1) above is more preferably 50 g/m$^2$ or more and 80 g/m$^2$ or less. The amount indicated in (2) above is more preferably 35 g/m$^2$ or more and 55 g/m$^2$ or less, and the amount indicated in (3) above is more preferably 60 g/m$^2$ or more and 90 g/m$^2$ or less.

Incidentally, the amount of the Al plating can be measured by using a known method such as, for example, the fluorescent X-ray analysis. For example, a calibration curve showing the relation between the intensity of fluorescent X-ray and the amount is determined in advance by using specimens of which the Al amount is known, and then the amount of the Al plating can be determined from the measurement results of the intensity of fluorescent X-ray by using the calibration curve.

In the embodiment of the present invention, the above-described Al plated steel sheet is shaped into a part by hot forming. Thereby, the components of the Al plating and the steel sheet are reacted during the hot forming, and change to an Al—Fe based intermetallic compound. As the Al—Fe type or a type in which the Al—Fe type contains Si, many compounds are known, and thus the alloyed plating layer has a complicated structure. As a typical example, the alloyed plating layer has a structure that is similar to 5 layers being stacked. Such a plating layer including a plurality of alloyed layers is hereinafter referred to as an "intermetallic compound layer".

Figure 2:
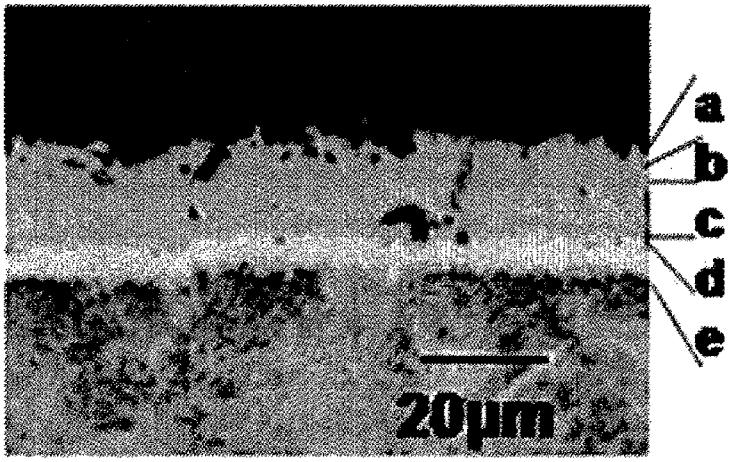
FIG. 2 is a cross-sectional photograph showing a typical Al—Fe layer and a diffusion layer.

In the embodiment of the present invention, the thickness of a diffusion layer, which is located closest to the steel sheet in the Al—Fe layer (intermetallic compound layer), is specified as 10 μm or less. FIG. 2 shows a typical Al—Fe layer and a typical diffusion layer. A polished cross section is subjected to nital etching to obtain such a cross-sectional structure. Here, an intermetallic compound layer according to the embodiment of the present invention has a structure that is similar to 5 layers a to e being stacked as shown in FIG. 2 by way of example, and the layers d and e together are defined as a "diffusion layer". Note that the number of layers in the intermetallic compound layer in the embodiment of the present invention is not limited to five as shown in FIG. 2 by way of example. Even if the intermetallic compound layer has layers other than five, the first and the second layer in the intermetallic compound layer, which are located closest to the steel sheet, can be regarded as the diffusion layer.

The thickness of the diffusion layer is specified as 10 μm or less. This is because spot weldability is dependent on this thickness. The thickness of the diffusion layer exceeding 10 μm tends to generate welding dust and causes the proper range of welding current to be narrower. Although the lower limit of the thickness of the diffusion layer is not specified here, the diffusion layer of 1 μm or more in thickness is normally present, and thus 1 μm practically becomes the lower limit.

<Surface Coating Layer>

The surface coating layer is layered on the surface of an Al plating layer as described above. The surface coating layer contains at least ZnO. The surface coating layer may be formed by using a liquid in which ZnO particles are suspended in an aqueous solution and applying the suspension onto the Al plating with a roll coater, etc. The surface coating layer provides an effect of improving lubricity in hot pressing and reactivity in the reaction with a chemical conversion liquid.

Besides ZnO, the surface coating layer may contain, for example, an organic binder component. A water-soluble resin such as, for example, polyurethane resin, polyester resin, acrylic resin, and a silane coupling agent may be used as the organic binder component. As oxides besides ZnO, the surface coating layer may contain, for example, $SiO_2$, $TiO_2$, and $Al_2O_3$, etc.

The methods for applying the suspension may include, for example, a method in which the above-described suspension containing ZnO is mixed with a predetermined organic binder and is applied on the surface of the Al plating layer, and a method for applying by using powder coating.

Although a grain size (average grain size) of ZnO is not specifically limited here, it is preferable to have a grain size of, for example, approximately 50 nm or more and 1000 nm or less in diameter, and more preferably, 50 nm or more and 400 nm or less. Note that the grain size of ZnO is defined as a grain size after hot pressing. Typically, the grain size is to be determined by observation with a scanning electron microscope (SEM) or an equivalent device after undergoing the process in which a sample is retained in a furnace at 900° C. of a sheet temperature for 5 to 6 minutes and rapidly cooled with dies. The organic contents in the binder is decomposed during hot pressing, and only oxides remain to exist in the surface coating.

Although the amount of the surface coating including ZnO is not specifically limited, it is preferable to be 0.3 $g/m^2$ or more and 3 $g/m^2$ or less in metallic Zn equivalent for one surface of the steel sheet. The ZnO amount of 0.3 $g/m^2$ or more in metallic Zn equivalent can efficiently provide effects such as lubricity improvement, etc. In contrast, if the amount of ZnO exceeds 3 $g/m^2$ in metallic Zn equivalent, the thickness of the above-described Al plating layer and the surface coating layer becomes excessive, thereby deteriorating weldability. Thus, it is preferable that the surface coating layer on one surface contains ZnO of 0.3 $g/m^2$ or more and 3 $g/m^2$ or less in metallic Zn equivalent. A ZnO amount of 0.5 $g/m^2$ or more and 1.5 $g/m^2$ or less is especially preferable. By keeping the ZnO amount in a range of 0.5 $g/m^2$ or more and 1.5 $g/m^2$ or less, the lubricity in hot pressing is secured, and weldability and paint adhesion become better as well. The surface coating layer may contain, besides ZnO and the binder, compounds such as, for example, Mg, Ca, Ba, Zr, P, B, V, and Si.

Methods for baking and drying after coating application, which use, for example, an air-heating furnace, an induction heating furnace, a near infrared ray furnace, and the like, may be utilized separately or in combination. Depending on the type of binder used in coating application, hardening treatment may be carried out by using, for example, ultraviolet ray, electron beam, or the like, instead of the baking and drying after coating application. The baking temperature after coating application is approximately in a range of 60 to 200° C. in many cases. The methods of forming the surface coating layer is not limited to such examples, but can include various other methods.

When the binder is not used, the adhesion of coating after applied onto the Al plating layer and before heating is slightly low and the coating may be coming off when rubbed strongly.

Now, a zinc phosphate coating will be described.

In a typical painting process for automobiles, an immersion-type chemical conversion is carried out before electrodeposition painting. The chemical conversion is carried out by using a known chemical conversion liquid containing phosphates. The chemical conversion causes zinc in the coating, including ZnO, to react with phosphates contained in the chemical conversion liquid to form a zinc phosphate coating on the surface of the steel sheet on which the Al plating layer and the surface coating layer have been formed. The zinc phosphate coating improves adhesion to a paint film and also contributes to the corrosion resistance after coated with paint. For example, in the case of a known Al plated steel sheet as described in Patent Literature 1 listed above, the alloyed Al—Fe surface, which is covered with a stiff Al-oxide coating, has exhibited a low reactivity with the chemical conversion liquid. Patent Literature 2 listed above describes a technique to improve the reactivity with the chemical conversion liquid. The zinc phosphate coating (chemical conversion coating) similar to that described in Patent Literature 2 listed above is also used in the embodiment of the present invention. Depositing the coating containing ZnO improves the reactivity between the Al plated steel sheet and the chemical conversion liquid, enabling the zinc phosphate coating to be formed.

The amount of zinc phosphate coating is governed almost by the content of ZnO. When the coating containing ZnO has ZnO of 0.3 $g/m^2$ or more and 3 $g/m^2$ or less for one surface in metallic Zn equivalent, the coating amount of zinc phosphate becomes approximately 0.6 $g/m^2$ or more and 3 $g/m^2$ or less for one surface. Although the zinc phosphate coating is formed on the surface of the surface coating layer, it is difficult to distinguish the zinc phosphate coating from the surface coating layer in a part product. Consequently, the thickness is regarded as a total thickness of the surface coating layer and the zinc phosphate coating in the part product. The total thickness of the surface coating layer and the zinc phosphate coating is approximately 0.5 μm or more and 3 μm or less when the ZnO amount for one surface is 0.3 $g/m^2$ or more and 3 $g/m^2$ or less in metallic Zn equivalent.

Incidentally, the ZnO amount of the surface coating layer and the coating amount of zinc phosphate can be measured by using a known analysis method such as the fluorescent X-ray analysis. For example, calibration curves showing the relation between the intensity of fluorescent X-ray and the amounts are determined in advance by using specimens of which the amount of Zn and the amount of phosphorus are known, and the ZnO amount and the coating amount of zinc phosphate can be determined from the measurement results of the intensity of fluorescent X-ray by using the calibration curves.

(Processing Using Hot Pressing Method)

The plated steel sheet according to the embodiment, which can be preferably utilized as a raw material of an automobile part according to the embodiment of the present invention, has so far been described. The plated steel sheet that is formed in a manner as described above is especially useful when the plated steel sheet is subjected to the processing in which the hot pressing method is used. Thus, the case in which the plated steel sheet having the above-described configuration is processed by using the hot pressing method will be described below.

In the hot pressing method according to the embodiment, the plated steel sheet is heated first to a high temperature to soften the plated steel sheet. The softened plated steel sheet is pressed and shaped, and then the shaped plated steel sheet is cooled. The temporarily-softened plated steel sheet can make the following pressing work easier. The plated steel sheet having the aforementioned components is, by undergoing heating and cooling, quenched to obtain a high mechanical strength of about 1500 MPa or more.

The plated steel sheet according to the embodiment is heated in the hot pressing method. As the heating method in the hot pressing method, a heating method using as a typical electric furnace, a radiant tube furnace, or infrared heating can be utilized.

In the heating, the Al plated steel sheet melts at the melting point or a temperature higher than the melting point and, at the same time, changes into an Al—Fe-based Al—Fe alloy layer (in other words, intermetallic compound layer) due to counter diffusion with Fe. The Al—Fe alloy layer has the high melting points, i.e., around 1150° C. A plurality of species of such Al—Fe compounds and Al—Fe—Si compounds that includes Si additionally exist and are transformed into compounds having a higher Fe concentration by heating to a high temperature or heating for a long period of time. The surface state desirable for a final product is that alloying proceeds to the surface and, at the same time, the Fe concentration in the alloy layer is not high. If unalloyed Al remains to exist, the portion in which unalloyed Al remains corrodes rapidly, resulting in being quite vulnerable to cause blistering of the paint coating in terms of the corrosion resistance after coated with paint, which is not desirable. On the other hand, if the Fe concentration in the Al—Fe alloy layer becomes too high, the corrosion resistance of the Al—Fe alloy layer itself becomes lower, which also results in being vulnerable to cause blistering of the paint coating in terms of the corrosion resistance after coated with paint. This is because the corrosion resistance of the Al—Fe alloy layer depends on the Al concentration in the alloy layer. Consequently, there exist a desirable alloying state in terms of the corrosion resistance after coated with paint, and the alloying state is determined based on the Al amount of plating and the heating conditions.

Moreover, in the embodiment of the present invention, the Al plated steel sheet, which has a coating containing ZnO (in other words, surface coating layer), is formed using hot pressing, in which surface roughness after forming becomes important. In terms of controlling the surface roughness after the Al—Fe alloy layer is formed, it is important to control three factors such as the amount of Al plating, a rate of temperature increase, and a reaching steel sheet temperature.

An especially influencing factor is the rate of temperature increase. The surface roughness can be reduced by increasing temperature at a temperature increase rate of 12° C./second or more, irrespective of the amount of Al plating and the steel sheet temperature to be reached. Here, the rate of temperature increase is the average rate of temperature increase from 50° C. to "a reaching steel sheet temperature−30° C.". With this temperature increase pattern, the amount of Al plating is set at 30 g/m$^2$ or more and 110 g/m$^2$ or less. The reason is that the amount of plating of less than 30 g/m$^2$ causes the corrosion resistance provided by the Al plating to be not enough, while the amount of plating of more than 110 g/m$^2$ causes excessively thick plating, which tends to come off and adhere to dies during forming. The amount of Al plating is more preferably 50 g/m$^2$ or more and 80 g/m$^2$ or less. The upper limit of the rate of temperature increase is not specified here, but it is difficult to obtain a rate of temperature increase of 300° C./second or more even by using a method such as electric heating, etc. With this temperature increase pattern, the rate of temperature increase is preferably 12° C./second or more and 150° C./second or less. In addition, with this temperature increase pattern, the reaching steel sheet temperature is set at 870° C. or more and 1100° C. or less although it does not affect the surface roughness. When the reaching steel sheet temperature is less than 870° C., it may not complete alloying. On the other hand, when the reaching steel sheet temperature exceeds 1100° C., the alloying proceeds excessively, which may cause a defect in the corrosion resistance.

In contrast, if the rate of temperature increase is less than 12° C./second, the surface roughness varies, depending on the amount of Al plating and the reaching steel sheet temperature. There is a tendency in which the surface roughness becomes smaller when the amount of Al plating is smaller. Consequently, with this temperature increase pattern, the amount of Al plating is set at 30 g/m$^2$ or more and less than 60 g/m$^2$ for one surface. In addition, when the plated steel sheet with this amount of Al plating is heated at a rate of temperature increase of less than 12° C., the reaching steel sheet temperature is set at 850° C. or more and 950° C. or less. In this case, it is difficult to obtain the corrosion resistance if the amount of Al plating is less than 30 g/m$^2$. In addition, the reaching steel sheet temperature of less than 850° C. may cause insufficient hardness after quenching, whereas the reaching steel sheet temperature of more than 950° C. causes the diffusion of Al—Fe to progress too far, which deteriorates the corrosion resistance. In this temperature increase pattern, the lower limit of the rate of temperature increase is not specified, but the rate of temperature increase of less than 1° C./second lacks economic rationality dramatically, regardless of the amount of plating. Moreover, in this temperature increase pattern, the amount of Al plating is preferably 35 g/m$^2$ or more and 55 g/m$^2$ or less, the reaching steel sheet temperature is preferably 850° C. or more and 900° C. or less, and the rate of temperature increase is preferably 4° C./second or more and 12° C./second or less.

In contrast, if the rate of temperature increase is less than 12° C./second, and the amount of Al plating is large, the surface roughness tends to be larger, and thus it is important to strictly control the reaching steel sheet temperature. When the reaching steel sheet temperature is high, the surface roughness tends to be small. Thus, when the amount of Al plating is 60 g/m$^2$ or more and 110 g/m$^2$ or less for one surface, it is important to control the reaching steel sheet temperature to be 920° C. or more and 970° C. or less with this temperature increase pattern. When the amount of Al plating exceeds 110 g/m$^2$ for one surface, excessively thick Al plating tends to come off and may adhere to the dies during forming. On the other hand, when the reaching steel sheet temperature is less than 920° C., the surface roughness tends to become large, and it is difficult to maintain the corrosion resistance when the electrodeposition paint film is thin. The amount of Al plating is more preferably 60 g/m$^2$ or more and 90 g/m$^2$ or less. The lower limit of the rate of temperature increase is not specified here, but the rate of temperature increase of less than 1° C./second lacks economic rationality dramatically, regardless of the amount of plating. In addition, with this temperature increase pattern, the reaching steel sheet temperature is preferably 940° C. or more and 970° C. or less, and the rate of temperature increase is preferably 4° C./second or more and 12° C./second or less.

When the amount of Al plating is set at 30 g/m$^2$ or more and 110 g/m$^2$ or less, the thickness of the Al—Fe alloy layer (in other words, the thickness of the intermetallic compound layer) in a hot-pressed part product becomes approximately 10 μm or more and 50 μm or less. Accordingly, it is preferable that the thickness of the Al—Fe alloy layer falls in this range.

Next, the reason to limit the surface roughness after hot pressing will be described. The embodiment of the present invention provides parts having a better corrosion resistance after coated with paint by controlling the surface roughness to have a specified value or less as described above when the thickness of the electrodeposition paint film is less than 15 μm. As an index of the surface roughness, a maximum profile height (Rt) according to JIS B0601 (2001) (JIS B0601 (2001) is a standard corresponding to ISO 4287), is used. The maximum profile height (Rt) is defined as the sum of the maximum peak height and the maximum valley depth in a length to be evaluated in a roughness curve. This value roughly corresponds to the difference between the maximum value and the minimum value in the roughness curve. In the high-strength automobile parts according to the embodiment of the present invention, the maximum profile height Rt of the surface coating layer is set at 3 μm or more and 20 μm or less. It is not practically possible to make the maximum profile height Rt less than 3 μm, and thus the lower limit is set at this value. If the maximum profile height Rt exceeds 20 μm, corrosion starts to occur from a thin portion of the electrodeposition paint film, which is generated due to surface irregularities, and thus the upper limit is set at 20 μm. The maximum profile height Rt of the surface coating layer is more preferably 7 μm or more and 14 μm or less.

(Example of Effect by Plated Steel Sheet and Hot Pressing Method)

The plated steel sheet to be used for the automobile parts according to the embodiment of the present invention, and the hot pressing method for the plated steel sheet, have so far been described. The automobile part formed using the plated steel sheet according to the embodiment has the surface coating layer containing ZnO, zinc phosphate, etc., so that, for example, a high degree of lubricity is achieved and chemical conversion treatability is improved, as described above.

The reason why ZnO contributes to the adhesion of the chemical conversion coating is that the chemical conversion reaction is triggered and made to proceed by the etching reaction in which acid reacts with a material. On the other hand, ZnO itself is an amphoteric compound and is solved in acid so that ZnO reacts with the chemical conversion liquid.

(Automobile Parts)

The above-described Al plated steel sheet is subjected to the above-described hot pressing work so that the automobile parts according to the embodiment of the present invention are manufactured. The automobile part has the intermetallic compound layer formed of the Al—Fe intermetallic compound of 10 μm or more and 50 μm or less in thickness on the surface of the formed steel sheet (steel sheet as the base metal), and the thickness of the diffusion layer located closest to the steel sheet in the intermetallic compound layer is 10 μm or less. In addition, the surface coating layer including the coating containing ZnO and the zinc phosphate coating is provided on the surface of the intermetallic compound layer, and the surface roughness of the surface coating layer is 3 μm or more and 20 μm or less as a maximum profile height Rt in accordance with JIS B0601 (2001). Moreover, the electrodeposition paint film having a thickness of 6 μm or more and less than 15 μm is provided on the above-described surface coating layer. This automobile part exhibits a high mechanical strength such as, for example, 1500 MPa or more.

Incidentally, the electrodeposition paint film to be formed on the surface of the surface coating layer is not specifically limited, but a known electro-deposition paint film can be formed by using a known method. The thickness of the electrodeposition paint film is desirably 8 μm or more and 14 μm or less. The surface coating layer of the automobile part according to the embodiment of the present invention has a very flat surface whose surface roughness is 3 μm or more and 20 μm or less as a maximum profile height Rt. Thereby, the automobile part can stably provide excellent effects such as excellent corrosion resistance after coated with paint, excellent formability and productivity in the hot pressing work, and excellent chemical conversion treatability after hot press-forming, even if the electrodeposition paint film is made very thin as described above.

EXAMPLES

The automobile part according to the embodiment of the present invention will now be described more specifically with reference to examples. Note that Examples as described below are merely examples of the automobile part according to the embodiment of present invention, and the automobile part according to the embodiment of present invention is not limited to those examples described below.

Example 1

In Example 1, a cold-rolled steel sheet (sheet thickness of 1.2 mm) having steel composition as shown in Table 1 was used, and the cold-rolled steel sheet was plated with Al. The annealing temperature used was about 800° C. The Al plating bath contained Si: 9% and an about 2% amount of Fe that had been eluted from steel strips. The amount after plating was adjusted, by using a gas wiping method, to 20 $g/m^2$ or more and 120 $g/m^2$ or less for one surface. After the plated steel sheet was cooled, the suspension, which contained ZnO of which a particle diameter was about 50 nm, and an acrylic binder of which the amount was 20% as a ratio to the ZnO amount, was applied with a roll coater, and the plated steel sheet was baked at about 80° C. The amount was set in the range of 0.1 $g/m^2$ or more and 4 $g/m^2$ or less as an amount of metallic Zn. The average primary crystal diameter was adjusted by changing the amount of plating and the cooling rate. The average primary crystal diameter was calculated by the method described above by observing a cross-section of the structure using an optical microscope.

TABLE 1

| Steel Components of Specimens (unit: mass %) | | | | | | | |
|---|---|---|---|---|---|---|---|
| C | Si | Mn | P | S | Ti | B | Al |
| 0.22 | 0.13 | 1.20 | 0.005 | 0.002 | 0.02 | 0.004 | 0.03 |

The plated steel sheet was hot-stamped on the conditions as described below. There were employed two heating methods: a method in which the plated steel sheet was inserted into an air atmosphere furnace being set at a constant temperature, and a method in which a far-infrared ray furnace having two zones. In the latter method, one zone was kept at 1150° C. and the other zone was kept at 900° C. The plated steel sheets were heated to 800° C. in the 1150° C. furnace, and then transferred to the 900° C. furnace. Thermocouples were welded to each of the plated steel sheets to actually measure the sheet temperature, and the average rate of temperature increase from 50° C. to "a reaching steel sheet temperature−30" ° C. was measured.

Figure 3:
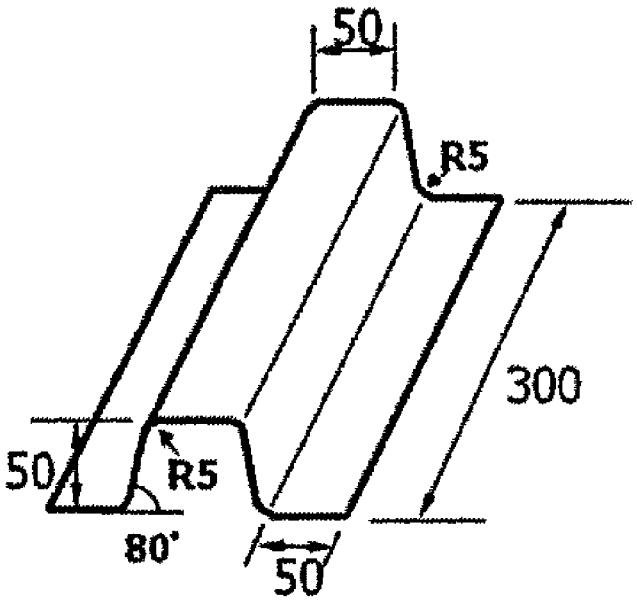
FIG. 3 is a perspective view illustrating a shape of a hat-shaped product manufactured in Example 1.

After the reaching steel sheet temperature and the sample holding time at the reaching steel sheet temperature were adjusted, the plated steel sheet was pressed into a hat shape, and was quenched by cooling it for 10 seconds at the bottom dead center. Subsequently, a sample was cut out from the hat-shaped product to evaluate the corrosion resistance. FIG. 3 illustrates the shape of the product used at that time and a cut-out portion. The cut-out sample was subjected to chemical conversion treatment using a chemical conversion liquid (PB—SX35) containing phosphates available from Nihon Parkerizing Co., Ltd. The sample was then coated with electro-deposition paint (Powernics 110) available from Nippon Paint Co., Ltd. so as to target the film thickness for 5 μm or more and 20 μm or less, and the sample was baked at 170° C.

The corrosion resistance after coated with paint was evaluated in accordance with JASO M609 established by the Society of Automotive Engineers of Japan. The sample was subjected to a corrosion test of 180 cycles (60 days) with the edges of the sample being sealed and with no scratch being provided on the paint film. Corrosion condition after the test was observed and evaluated according to a criteria listed below. As a comparative sample, an alloyed hot-dip galvanized steel sheet of 45 g/m$^2$ on one side was cold-formed into the hat shape and was evaluated in a similar way. The result was "B".

A: with red rust, no blistering

B: with red rust, a blistered area of 3% or less

C: with red rust, a blistered area of 5% or less

D: with red rust, a blistered area exceeding 5%

In addition, the surface roughness (Rt) was measured for the samples that had undergone chemical conversion in accordance with JIS B0601 (2001). The thickness of the diffusion layer was then determined by observing, with an optical microscope, the cross-section of the sample that had been treated by 3% nital etching after observing the pre-treated cross-section with the microscope.

After the hat forming, the detachment of Al—Fe from the internal surface of an R portion (compressive stress portion) was observed. The degree of the detachment was then evaluated by visual observation. Such detachment is not desirable because the Al—Fe detached from the compressive stress portion adheres to the die and causes press products to be scratched.

A: almost no detachment

B: small detachment

C: large detachment

For spot weldability, a 1.4 millimeter-thick flat sheet was heated and subjected to die quenching under the heating conditions same as the hat forming test. Proper range of welding current was evaluated for this sample at 12 cycle with a single-phase AC current source (60 Hz) and a pressure of 400 kgf (1 kgf approximately equals to 9.8 N). The evaluation was conducted using a criteria listed below with the lower limit set at $4\times(t)^{0.5}$ (t is thickness) and the upper limit set at dust generation.

A: proper range is 1.5 kA or more

B: proper range is less than 1.5 kA

Obtained results were summarized in Table 2. In this Table, the amount of plating and the amount of ZnO are both for one surface, and the amount of ZnO is expressed as an amount of metallic Zn. As the surface coating layer, the coating containing ZnO and the coating containing zinc phosphate have been confirmed to be formed in any of the samples corresponding to the present invention.

TABLE 2

Evaluation Results

| No | Plating amount (g/m$^2$) | ZnO amount (g/m$^2$) | Al primary crystal diameter (μm) | Temperature increase rate (° C./sec) | Reaching steel sheet temperature (° C.) | Intermetallic compound layer thickness (μm) | Diffusion layer thickness (μm) | Rt (μm) | Electro-deposition paint film thickness (μm) | Corrosion resistance after coated with paint | R portion detachment | Weldability | Remark |
|---|---|---|---|---|---|---|---|---|---|---|---|---|---|
| 1 | 25 | 2 | 6 | 15 | 880 | 8 | 3 | 5 | 11 | D | A | A | Comparative example |
| 2 | 35 | 2 | 7 | 15 | 880 | 12 | 3 | 6 | 11 | B | A | A | Present example |
| 3 | 45 | 1.5 | 8 | 15 | 900 | 16 | 4 | 10 | 10 | A | A | A | Present example |
| 4 | 55 | 1.2 | 9 | 15 | 900 | 21 | 4 | 13 | 11 | A | A | A | Present example |
| 5 | 65 | 0.9 | 10 | 15 | 950 | 26 | 5 | 14 | 10 | A | B | A | Present example |
| 6 | 80 | 0.7 | 11 | 15 | 980 | 33 | 6 | 15 | 11 | A | B | A | Present example |
| 7 | 95 | 0.5 | 12 | 15 | 1000 | 40 | 7 | 15 | 11 | A | B | A | Present example |
| 8 | 105 | 0.4 | 13 | 15 | 1030 | 45 | 8 | 14 | 10 | A | B | A | Present example |
| 9 | 115 | 0.3 | 15 | 15 | 1060 | 52 | 9 | 13 | 11 | A | C | A | Comparative example |
| 10 | 80 | 0.5 | 13 | 15 | 850 | 28 | 2 | * | 11 | D | A | A | Comparative example |
| 11 | 65 | 0.5 | 12 | 15 | 1160 | 33 | 15 | 28 | 11 | D | B | B | Comparative example |
| 12 | 45 | 1.5 | 10 | 15 | 910 | 16 | 4 | 10 | 9 | B | B | A | Present example |
| 13 | 45 | 0.9 | 10 | 15 | 910 | 16 | 4 | 11 | 14 | A | B | A | Present example |
| 14 | 45 | 0.6 | 10 | 18 | 900 | 16 | 4 | 9 | 12 | A | A | A | Present example |

TABLE 2-continued

| Evaluation Results | | | | | | | | | | | | | |
|---|---|---|---|---|---|---|---|---|---|---|---|---|---|
| No | Plating amount ($g/m^2$) | ZnO amount ($g/m^2$) | Al primary crystal diameter (μm) | Temperature increase rate (° C./sec) | Reaching steel sheet temperature (° C.) | Intermetallic compound layer thickness (μm) | Diffusion layer thickness (μm) | Rt (μm) | Electrodeposition paint film thickness (μm) | Corrosion resistance after coated with paint | R portion detachment | Weldability | Remark |
| 15 | 45 | 0.8 | 10 | 10 | 900 | 16 | 4 | 12 | 12 | A | A | A | Present example |
| 16 | 45 | 1.1 | 10 | 5 | 900 | 16 | 5 | 13 | 12 | A | A | A | Present example |
| 17 | 35 | 2.5 | 9 | 5 | 860 | 12 | 4 | 12 | 11 | B | A | A | Present example |
| 18 | 45 | 1.3 | 11 | 5 | 900 | 16 | 5 | 13 | 11 | A | A | A | Present example |
| 19 | 55 | 1 | 13 | 5 | 930 | 21 | 6 | 14 | 11 | A | A | A | Present example |
| 20 | 65 | 0.8 | 15 | 5 | 930 | 26 | 6 | 15 | 11 | A | B | A | Present example |
| 21 | 80 | 0.7 | 17 | 5 | 940 | 33 | 7 | 17 | 11 | A | B | A | Present example |
| 22 | 95 | 0.6 | 19 | 5 | 950 | 40 | 7 | 16 | 10 | A | B | A | Present example |
| 23 | 105 | 0.4 | 21 | 5 | 970 | 45 | 9 | 14 | 11 | A | B | A | Present example |
| 24 | 115 | 0.4 | 23 | 5 | 970 | 52 | 9 | 14 | 10 | A | C | A | Comparative example |
| 25 | 45 | 0.7 | 10 | 5 | 980 | 20 | 11 | 13 | 11 | B | A | B | Comparative example |
| 26 | 55 | 0.4 | 11 | 5 | 830 | 21 | 3 | * | 11 | D | A | A | Comparative example |
| 27 | 65 | 1.1 | 12 | 5 | 990 | 31 | 12 | 12 | 11 | B | A | B | Comparative example |
| 28 | 95 | 1.6 | 15 | 5 | 890 | 40 | 5 | * | 11 | D | A | A | Comparative example |
| 29 | 80 | 0.8 | 13 | 5 | 900 | 33 | 5 | 23 | 11 | D | B | A | Comparative example |
| 30 | 45 | 0 | 10 | 5 | 900 | 18 | 5 | 14 | 11 | D | A | A | Comparative example |
| 31 | 45 | 0.7 | 10 | 5 | 900 | 18 | 5 | 14 | 5 | D | A | A | Comparative example |
| 32 | 65 | 0.7 | 45 | 15 | 900 | 26 | 5 | 24 | 11 | D | A | A | Comparative example |

*: In a state that alloying does not proceed to the topmost layer in which Al still remains In Table 2, it is shown that excellent corrosion resistance after coated with paint is exhibited when the amount of Al plating, the ZnO amount, the average primary crystal diameter, the rate of temperature increase, the reaching steel sheet temperature, and the thickness of the electrodeposition paint film are appropriate. However, a sufficient corrosion resistance is not obtained in the cases in which, for example, the amount of Al plating is small (no. 1), the ZnO amount is small (no. 30), the electrodeposition paint film is excessively thin (no. 31), the average primary crystal diameter is excessively large (no. 32). In addition, the corrosion resistance is reduced in the case in which the reaching steel sheet temperature is excessively low (no. 10) or excessively high (no. 11). In no. 11, the reaching steel sheet temperature is too high, which causes Al—Fe itself to melt so that the surface roughness becomes large. When the rate of temperature increase is small, an appropriate range of the reaching steel sheet temperature varies depending on the amount of Al plating. Especially when the amount of plating is thick and the reaching steel sheet temperature is get at around 900° C. (no. 29), the surface roughness increases, and thus sufficient corrosion resistance cannot be obtained. It has become apparent that, in such a case, it is thus necessary to set the reaching steel sheet temperature higher (no. 21, no. 22).

Heretofore, preferred embodiments of the present invention have been described in detail with reference to the appended drawings, but the present invention is not limited thereto. It should be understood by those skilled in the art that various changes and alterations may be made without departing from the spirit and scope of the appended claims.

As described in the foregoing, owing to the present invention, the lubricity has become better and the workability has improved in carrying out hot pressing of the Al-plated steel sheet, which enables more complicated pressing. Also enabled are labor saving in maintenance work of hot pressing equipment and an increase in productivity. The paint coating and the corrosion resistance of finished products are confirmed to improve because the chemical conversion treatability of the processed products after hot pressing becomes better. In view of the above, the present invention is sure to expand the application range of hot pressing of Al-plated steel and to enhance applicability of Al-plated steel materials to final products such as automobiles and industrial machines.

The invention claimed is:

1. An automobile part, comprising:

a formed steel sheet having an intermetallic compound layer formed on a surface of the steel sheet, the intermetallic compound layer, being formed of Al—Fe intermetallic compound having a thickness of 10 μm or more and 50 μm or less, the intermetallic compound layer including a diffusion layer positioned in closest proximity to the steel sheet, the diffusion layer having a thickness of 10 μm or less;

a surface coating layer provided on a surface of the intermetallic compound layer, the surface coating layer including a coating containing ZnO and a zinc phosphate coating and having a surface roughness of 3 μm or more and 20 μm or less as a maximum profile height Rt in accordance with JIS B0601 (2001); and an electrodeposition paint film provided on a surface of the surface coating layer and having a thickness of 6 μm or more and less than 15 μm, wherein the steel sheet is an Al plated steel sheet having an Al plating layer formed on a surface of the steel sheet serving as a base metal, and wherein the Al plating layer has an average primary crystal diameter of 4 μm or more and 40 μm or less before hot pressing.

2. The automobile part according to claim 1, wherein the maximum profile height Rt is 7 μm or more and 14 μm or less.

3. The automobile part according to claim 1, wherein a content of ZnO is 0.3 $g/m^2$ or more and 3 $g/m^2$ or less in metallic Zn equivalent for one surface.

4. The automobile part according to claim 1, wherein an amount of the Al plating layer is 30 $g/m^2$ or more and 110 $g/m^2$ or less for one surface.

5. The automobile part according to claim 1, wherein the ZnO has an average grain size of 50 μm or more and 1000 nm or less in diameter.

6. The automobile part according to claim 5, wherein a content of ZnO is 0.3 $g/m^2$ or more and 3 $g/m^2$ or less in metallic Zn equivalent for one surface.

7. The automobile part according to claim 6, wherein an amount of the Al plating layer is 30 $g/m^2$ or more and 110 $g/m^2$ or less for one surface.

* * * * *